United States Patent [19]

Toshima

[11] Patent Number: 4,774,385

[45] Date of Patent: Sep. 27, 1988

[54] ELECTRICAL BUSHING FOR USE WITH A GAS INSULATED ELECTRICAL APPARATUS

[75] Inventor: Norichika Toshima, Amagasaki, Japan

[73] Assignee: Mitsubishi Denki Kabushiki Kaisha, Japan

[21] Appl. No.: 24,465

[22] Filed: Mar. 11, 1987

[30] Foreign Application Priority Data

Mar. 12, 1986 [JP] Japan ..... 61-52637

[51] Int. Cl.[4] ..... H01B 17/26; H01B 17/42

[52] U.S. Cl. ..... 174/142; 174/31 R

[58] Field of Search ..... 174/15 BH, 16 BH, 31 R, 174/142, 143

[56] References Cited

U.S. PATENT DOCUMENTS 4,629,822 12/1986 Kitamura ..... 174/12 BH

FOREIGN PATENT DOCUMENTS 54-102595 8/1979 Japan ..... 174/143

54-111696 9/1979 Japan ..... 174/142

56-71007 6/1981 Japan ..... 174/142

1544485 4/1979 United Kingdom ..... 174/31 R

*Primary Examiner*—Laramie E. Askin

*Attorney, Agent, or Firm*—Leydig, Voit & Mayer

[57] ABSTRACT

An electrical bushing for use with a gas insulated electrical apparatus comprises an insulating tube, a central conductor extending through said insulating tube, a grounded cylindrical shield disposed between the central conductor and the insulating tube, an intermediate shield disposed between, and electrically insulated from, the cylindrical shield and the central conductor so as to surround the latter. The intermediate shield has a reduced diameter portion in the vicinity of the free end of the grounded cylindrical shield, large diameter portions and tapered portions connecting the reduced diameter portion to the large diameter portions to provide a smooth distribution of the electric field between the central conductor and the field moderating ring, so that the concentration of the electric field is moderated by the grounded shield and the intermediate shield.

1 Claim, 2 Drawing Sheets

ELECTRICAL BUSHING FOR USE WITH A GAS INSULATED ELECTRICAL APPARATUS

BACKGROUND OF THE INVENTION

This invention relates to an electrical bushing for use with a gas insulated electrical apparatus, and more particularly to an electrical bushing in which the concentration of an electric field is moderated by a grounded shield and an intermediate shield.

FIG. 1 illustrates one example of a conventional electrical bushing for use with a gas insulated electrical apparatus which is disclosed in Japanese Utility Model Application Laid Open No. 56-71007.

The conventional electrical bushing comprises an insulating tube 1 such as a porcelain tube, an upper mounting fixture 12 secured to one end of the tube 1, an upper terminal 11 hermetically secured to the tube 1 through the fixture 12, a lower mounting fixture 10 secured to the other end of the tube 1, a flange 5 which is grounded and hermetically secured to the insulating tube 1 through the mounting fixture 10, and a grounded vessel 7, having a flange member 7*a* at the top end thereof and which is hermetically secured to the flange 5.

The electrical bushing further comprises a central conductor 2 axially disposed at the center of the hollow portion of the tube 1 to be used as a high voltage electrode, and grounded hollow cylindrical shield 3, having a field moderating ring 3*a* formed at one end thereof and fixed at the other end thereof to the inner circumferential edge of the flange 5 along the inner wall of the tube 1. An intermediate cylindrical shield 4 is disposed between the central conductor 2 and the cylindrical grounded shield 3 so as to surround the central conductor 2, and is supported in the tube 1 by an insulator 6 which is fixed at one end thereof to the flange 5 and at the other end thereof to the intermediate shield 4 for supporting the shield 4. An insulating gas 8, such as $SF_6$ gas, is filled within the electrical apparatus.

In the conventional electrical bushing as above described, the voltage distribution in the inner space of the tube 1 is determined by the ratios of the electrostatic capacity between the central conductor 2 and the intermediate shield 4, and that between the grounded shield 3 and the intermediate shield 4. In determining the electric field in the insulating gas 8, it is necessary to consider the balance of the electric field between the electric field moderating ring 3*a* of the grounded shield 3 and a portion of the central conductor 2 which is surrounded by the intermediate shield 4.

Further, it has been recently attempted to minimize the dimensional size of the insulating tube 1 so that the production cost of the tube may be cut down. Accordingly, the inner space of the tube is very limited, so that the insulating distance between the field moderating ring 3*a* of the grounded shield 3 and the intermediate shield 4 becomes shorter.

The conventional electrical bushing described above has problems in that, when a high voltage is applied to the central conductor 2, the electric field is considerably higher around the field moderating ring 3*a* of the grounded shield 3, resulting in a limitation to the withstand voltage characteristics thereof. In this context, the field moderating ring 3*a* must have a cross-sectional shape having as large a radius as possible to moderate the concentration of the electric field, and, as a result, the inner diameter of the tube 1 has to be enlarged, contradicting the minimum size and production cost requirements.

SUMMARY OF THE INVENTION

Accordingly, an object of this invention is to provide an electrical bushing free from the above-discussed problems.

Another object of this invention is to provide an electrical bushing which can be made smaller in size than the conventional bushing.

According to this invention, the electrical bushing comprises an insulating tube, a central conductor extending through the insulating tube, a cylindrical shield disposed between the insulating tube and the central conductor, the shield being connectable to ground at one end thereof and having an electric field moderating ring at the other end thereof. The electrical bushing further comprises an intermediate tubular shield disposed between and electrically insulated from the central conductor and the grounded cylindrical shield so as to surround the central conductor. The intermediate tubular shield includes a portions having a reduced diameter in the vicinity of the field moderating ring of the grounded cylindrical shield, large diameter portions, and tapered portions connecting the reduced diameter portion to the large diameter portions, thereby making it possible to equally share the electrostatic capacities between the central conductor and the intermediate shield, and between the intermediate shield and the field moderating ring of the grounded cylindrical shields without increasing the size (and production cost) of the electrical bushing.

BRIEF DESCRIPTION OF THE DRAWINGS

This invention will become more readily apparent from the following detailed description of the preferred embodiment of this invention taken in conjunction with the accompanying drawings, in which.

DETAILED DESCRIPTION OF THE PREFERRED EMBODIMENT

Figure 2:
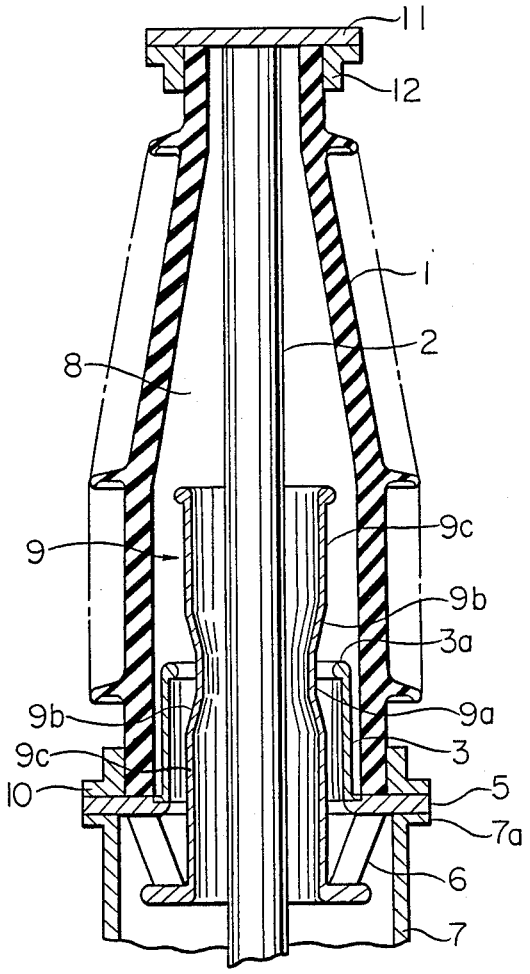
FIG. 2 is a longitudinal sectional view of an electrical bushing according to one embodiment of this invention.

FIG. 2 illustrates an electrical bushing according to one embodiment of this invention.

Figure 1:
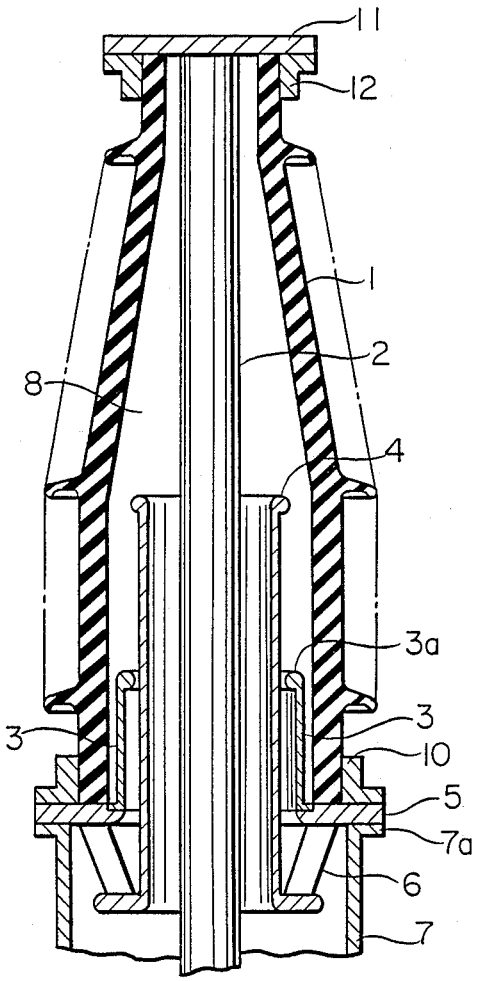
FIG. 1 (PRIOR ART)
FIG. 1 is a longitudinal sectional view of a conventional electrical bushing.

According to this invention, the electrical bushing is substantially similar to the conventional bushing shown in FIG. 1 except for the configuration of an intermediate shield. In other respects, the structure is substantially the same as that of the conventional electrical bushing illustrated in FIG. 1.

According to this invention, the electrical bushing includes an intermediate shield 9 having a reduced diameter portion 9*a* in the vicinity of the field moderating ring 3*a* of the grounded shield 3, and large diameter portions 9*c*, tapered portions 9*b* connecting the reduced diameter portion 9*a* to the large diameter portions 9*c*.

The thus constructed electrical bushing provides a sufficient insulating distance between the field moderating ring 3*a* of the grounded shield 3 and the intermediate shield 9 to provide an improved electric field condition in this region without increasing the dimensional size of the bushing.

Although the insulating distance between the central conductor 2 and the reduced diameter portion 9*a* of the intermediate shield 9 is less than the insulation distances between the central conductor 2 and the other portions, the electric field strength therebetween can be maintained substantially the same by selecting proper diameters of the central conductor 2 and the intermediate shield 9.

Further, although the equipotential surfaces between the reduced diameter portion 9*a* of the intermediate shield 9 and the central conductor 2 are dense in comparison to those in the other regions in the bushing, the electric field strength is actually lower than that of the conventional electrical bushing in which the intermediate shield 9 has the same diameter along all portions thereof. This condition is achieved by the utilization of the tapered portions 9*b* which smoothly connect the reduced diameter portion 9*a* to the large diameter portions 9*c* so as to form a smooth electric field strength transition therebetween.

As can be seen from the above description, the electrical bushing according to an embodiment of the invention includes an intermediate shield having a reduced diameter portion in the vicinity of the field moderating ring of the shield, the reduced diameter portion being connected to the large diameter portions by respective tapered portions, thereby making it possible to moderate the concentration of the electric field around the field moderating ring, so that the withstand voltage characteristics of the bushing are considerably improved.

Further, the insulating distance between the central conductor and the intermediate shield, and that between the intermediate shield and the grounded cylindrical shield in the bushing are properly maintained without increasing the dimensional size of the bushing and the electric field strength around the field moderating ring of the grounded shield is lowered, thereby providing a compact electrical bushing at a low cost.

What is claimed is:

1. An electrical bushing for use with a gas insulated electrical apparatus including:

an insulating tube;

a central conductor extending through said insulating tube;

a grounded cylindrical shield disposed between said central conductor and said insulating tube so as to surround said central conductor, said grounded cylindrical shield being electrically connected to ground at one end thereof and having an electric field moderating ring at the other end thereof; and an intermediate tubular shield disposed between, and electrically insulated from, said grounded cylindrical shield and said central conductor and extending laterally in a symmetrical relationship from the vicinity of said field moderating ring of said grounded cylindrical shield;

said intermediate tubular shield having a short reduced diameter portion within said field moderating ring of said grounded cylindrical shield, longer larger diameter portions, and tapered portions connecting said short reduced diameter portion to said longer larger diameter portions, a major portion of said intermediate tubular shield comprising said larger diameter portions, one of said tapered portions being located totally within said grounded cylindrical shield, said intermediate tubular shield extending symmetrically from a central part of said short reduced diameter portion which is located within said field moderating ring to equally share electrostatic capacities between said central conductor and said intermediate tubular shield for a smooth electric field strength transition therebetween and to uniformly spread the electric field throughout the entire bushing.

* * * * *